United States Patent [19]

Corll

[11] 4,101,136

[45] Jul. 18, 1978

[54] EXERCISING APPARATUS

[76] Inventor: James A. Corll, #1 Westlake Dr. N.E., Albuquerque, N. Mex. 87112

[21] Appl. No.: 759,755

[22] Filed: Jan. 17, 1977

[51] Int. Cl.[2] ..... A63B 69/18

[52] U.S. Cl. ..... 272/97; 272/70

[58] Field of Search ..... 35/29 R; 272/97, 70, 272/109, 114, 111; 280/609

[56] References Cited

U.S. PATENT DOCUMENTS

| | | | |
|---|---|---|---|
| 1,982,843 | 12/1934 | Traver | 272/70 |
| 2,964,315 | 12/1960 | Dinning | 35/29 R X |
| 3,547,434 | 12/1970 | Ossenkop | 272/97 |
| 3,559,986 | 2/1971 | Ehrmantraut | 272/70 |
| 3,565,424 | 2/1971 | Macabet | 272/97 |
| 3,729,207 | 4/1973 | Reynolds | 272/97 |

FOREIGN PATENT DOCUMENTS

| | | | |
|---|---|---|---|
| 331,825 | 7/1930 | United Kingdom | 272/70 |

*Primary Examiner*—Richard J. Johnson
*Attorney, Agent, or Firm*—Richard A. Bachand

[57] ABSTRACT

Apparatus for use in exercising and toning muscles principally used in skiing includes a base having a supporting bottom with sides upwardly extending from a central apex about which the base is rockable between semi-stable positions. A pair of foot pedals rest atop the base within grooves parallel to each other and to the apex of the base of the block. The foot pedals are of generally triangular cross sectional shape to be rockable between semi-stable positions on the block. The foot pedals additionally are moveable forward and aft to simulate the foot positions of actual skiing.

16 Claims, 14 Drawing Figures

EXERCISING APPARATUS

BACKGROUND OF THE INVENTION

1. Field of the Invention

This invention relates to improvements in ski exercising apparatus, and more particularly to improvements in such apparatus which provide the user benefits both in physical conditioning and in proper skiing form.

2. Description of the Prior Art

The prior art includes many devices which a skier may use indoors with the object of improving or refining his muscular conditioning and/or form essential for proper skiing. A good illustration of this is given by a device invented by Robert J. Ossenkop and advanced in U.S. Pat. No. 3,547,434. This device permits the user to simulate a turn, as does the instant invention, by changing back and forth between left and right traverse positions. However, such devices of the prior art are bulky and relatively expensive to fabricate and assemble.

SUMMARY OF THE INVENTION

This invention relates to an improved exerciser for simulating skiing and for toning those muscles used in the skiing sport. The exerciser is compact and easily stored for use when desired in the privacy of a home or apartment, and thus provides the user an opportunity to exercise and train at any time.

It is, accordingly, an object of this invention to provide an improved ski exercising apparatus.

It is a further object of this invention to provide a compact ski exercising apparatus which will simulate traverse positions and edging requirements.

It is a yet further object of this invention to provide a ski exercising apparatus which requires proper weight distribution by the user to obtain a traverse position.

It is a yet still further object of this invention to provide a ski exercising apparatus wherein the user can simulate a turn.

Other objects, features and advantages of this invention will best be understood by reference to the following description taken in connection with the accompanying drawings.

BRIEF DESCRIPTION OF THE DRAWING

The invention is illustrated in the accompanying drawing, wherein.

DETAILED DESCRIPTION OF THE PREFERRED EMBODIMENTS

Figure 1:
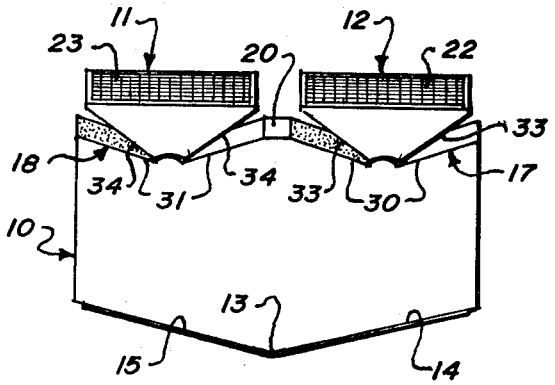
FIG. 1 is a front elevation view of a preferred embodiment of the ski exerciser of the invention.
Figure 2:
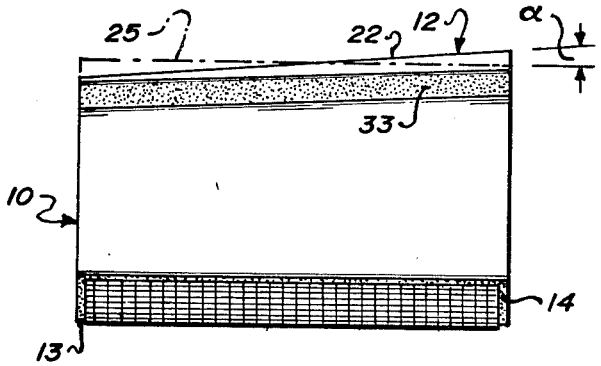
FIG. 2 is a right side elevation of the ski exerciser of FIG. 1.

FIGS. 1 and 2 illustrate a preferred embodiment of the invention, FIG. 1 being a front elevation view of the device located upon a horizontal floor surface (not shown), as the device is intended to be used, and FIG. 2 being a similar view, taken from the side.

The exerciser of the invention has three main parts, including a base 10 and two foot pedals 11 and 12. The foot pedals 11 and 12 are generally triangular cross-sectional configuration and rest in corresponding grooves 17 and 18 in the top 20 of the base 10. The base 10 is of roughly pipedon shape, having a front to back slightly rounded apex 13 along its bottom side with upwardly tapered sides 14 and 15. The shape allows the base 10 to be rocked between left and right semi-stable positions shown in FIGS. 3 and 4, and below described in detail.

Again with reference to FIG. 1, the grooves 17 and 18 are at a slight incline from horizontal, and the top surfaces 22 and 23 of the foot pedals 11 and 12 are additionally inclined at an similar angle with reference to their bases. Thus, when the foot pedals 11 and 12 are emplaced in one direction within the grooves 17 and 18, the top surfaces of the foot pedals are at a total inclined angle equal to the sum the inclined angles just mentioned. This total angle $\alpha$, can be seen in FIG. 2. This angle, however can be eliminated if desired, by reversing the front to back positions of the foot pedals 11 and 12 relative to the base 10. That is, the angles of the groove bottoms and foot pedal bases cancel, yielding foot pedal top surfaces that are horizontal as illustrated by the dashed line 25 in FIG. 2.

The front to back angle $\alpha$ of the foot pedals, seen in FIG. 2, is about the same as that provided by most pleasure skiing boots, so that the device can be used with or without such boots, as desired, by the proper orientation of the foot pedals 11 and 12 with respect to the base 10.

Figure 4:
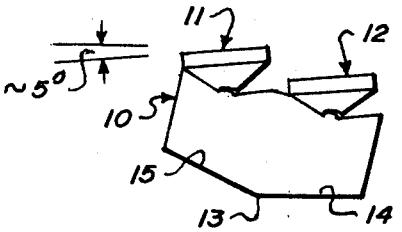
FIGS. 3 and 4 are front elevation views similar to FIG. 1 showing the semi-stable positions between which the exerciser is moveable in operation.
Figure 3:
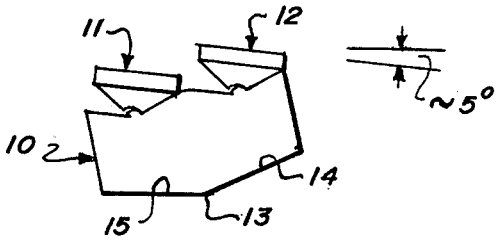

As shown in FIGS. 1, 3, and 4, the sides 30—30 and 31—31 of the respective generally V-shaped grooves 17 and 18 in the top of the base 10 define an angle larger than the angle defined between the respective foot pedals sides 33—33 and 34—34, enabling the foot pedals 11 and 12 to be rockingly or unstably received into the grooves 17 and 18. Furthermore, the difference between these angles is greater than the rotational angle between the two semi-stable position of the base. As a result, the full rotation of the foot pedals in either direction more than compensates for the full rotation of the base in the opposite direction, causing a definite lowering of the "uphill" edges of each foot pedal, about 5° in the illustrated embodiment, as seen in FIGS. 3 and 4.

The action of the foot pedals 11 and 12 is desireably through a smooth side to side rotation, rather than a sharp back and forth pivot. This smooth rotation is achieved by mating arcuate bearing surfaces 40 and 41, shown in FIG. 7, formed along portions of the apex of the foot pedal 12 and the groove 17. (The bearing surfaces are only provided at the front and back portions of the pedals and grooves to accommodate forward an aft sliding travel limits, as below discussed).

Figure 7:
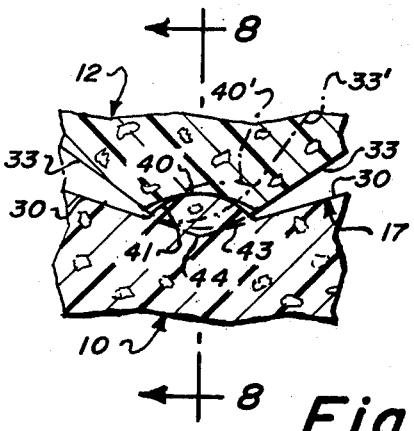
FIG. 7 is a cut away view of a portion of the exerciser, taken at 7—7 in FIG. 5.

The left rotation of the foot pedal 12 within the groove 17 is illustrated in FIG. 7 by the dotted lines 33' and 40'. The rotation to the right is similar. It should be noted that the radius of the circular section for the foot pedal is greater than that for the base, but the total arc lengths are equal, so that purely rolling motion can occur with resultant lessening of wear on these force bearing surfaces. In addition, the fully rotated position of the foot pedal shows that the front to back lines of contact between the foot pedal and the base translates sideways as the pedal is rocked from side to side.

Similarly, the rotation of the base 10 about its apex 13 causes the V-grooves 17 and 18 to translate sideways with respect to the apex 13. The magnitude of such translations is proportional to the height of the base 10 and in the opposite direction to the sideways translation of the foot pedal contact lines, when said pedals 11 and 12 are edged in the proper direction. The resultant of said sideways translations determines the weight distributions required on the foot pedals to maintain the base in the semi-stable positions. The required weight distributions, in combination with the foot positions simulate those of actual skiing.

Figure 8:
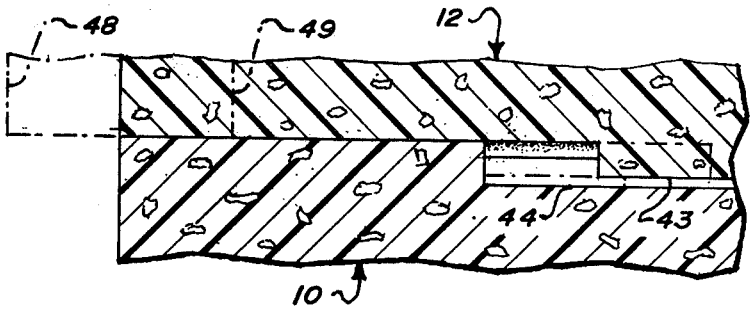
FIG. 8 is a cut away view of a portion of the exerciser, taken at 8—8 in FIG. 7.

As mentioned, the central portion 44 of the groove 17 in the base, and a shorter central portion 43 of the downward apex of the foot pedal 12 are not bearing surfaces and are employed to limit the forward and aft travel of the foot pedals 11 and 12 within their respective grooves. The central portion of the groove 17 is actually V-shaped, as shown by the dotted line 44 in FIG. 7, and the central portion of the foot pedal is rounded as shown by the dotted line 43. Since the central section 43 of the downward apex of the foot pedal 12 is compatable only within the longer central section of the groove 17 in the base, the foot pedal can slide upon the base 10, but only within the central limits. The sliding travel of the foot pedals toward the extreme forward and aft positions, relative to the base, is shown by the dashed lines 48 and 49, respectively, in FIG. 8.

Figure 9:
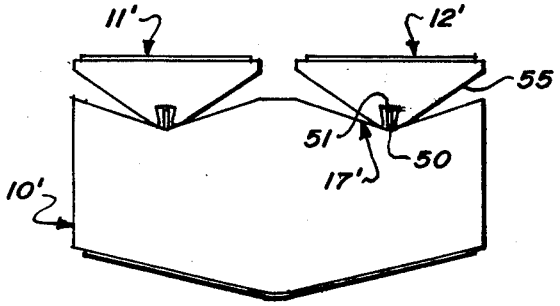
FIG. 9 is a front elevation view of an alternative preferred embodiment of the ski exerciser of the invention.
Figure 10:
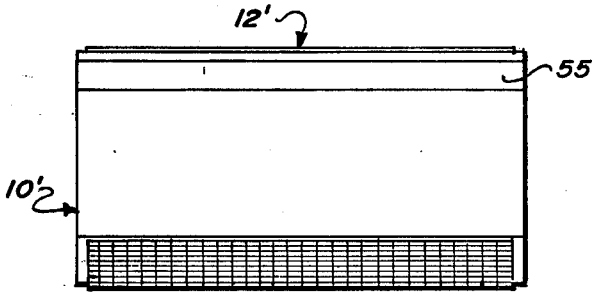
FIG. 10 is a right side elevation of the ski exerciser of FIG. 9.

FIGS. 9 and 10 illustrate another embodiment of the invention, corresponding, respectively, to the views presented by FIGS. 1 and 2, corresponding parts being denoted by a prime (') after the reference numeral. In this second embodiment, the inclination angles of the foot pedals previously discussed with reference to FIGS. 1 and 2 are not described.

Figure 11:
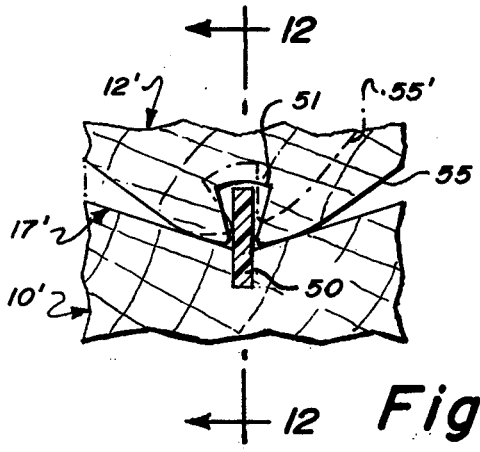
FIG. 11 is a cut away view of a portion of the exerciser of FIG. 9, showing the engagement of one foot pedal and its receiving groove.
Figure 12:
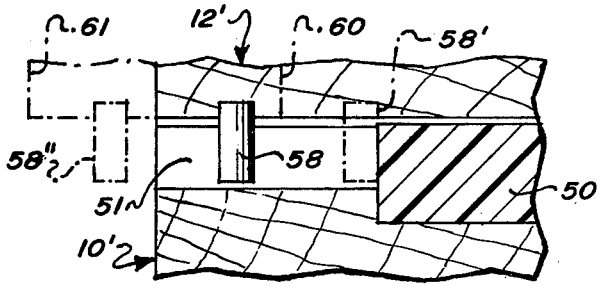
FIG. 12 is a cut away view of a portion of the exerciser taken at 12—12 in FIG. 11.

The actual engagement between the foot pedals and the base is somewhat different as can be clearly seen in FIGS. 11 and 12. A spline 50 is fixed to the base 10' along the bottom of the V-shaped groove 17', and a groove 51 is formed along the apex of the bottom of the foot pedal 12' to receive the spline 50. The spline and groove connections prevent the foot pedal from slipping sideways on the block. The groove 51, as can be seen in FIG. 11, has tapered sides to enable the rocking motion of the foot plate 12' about the spline 50 between the left position, shown by the dotted lines 55, and the right position, not shown.

The forward and aft travel of the foot pedal 12' is limited by the pegs 58 within the channel 51, as shown in FIG. 12. Thus, in the aft position, denoted by dotted line 60, the peg contacts the spline 50, as shown by the dotted lines 58'. At the forward limit, shown by the dotted lines 61 a similar peg (not shown) engages the spline 50 at a rearward location, whereby the forward peg 58 is located as shown by the dotted lines 58''.

Figure 13:
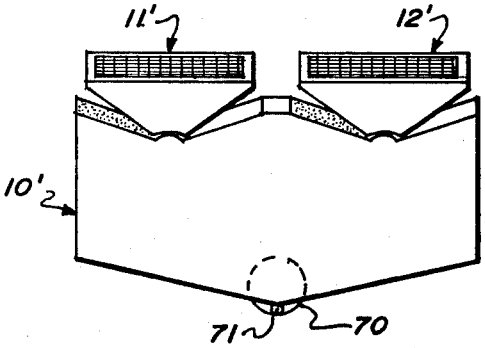
FIG. 13 is a front elevation view of another preferred embodiment of the ski exerciser of the invention, showing an overall rotational capability.
Figure 14:
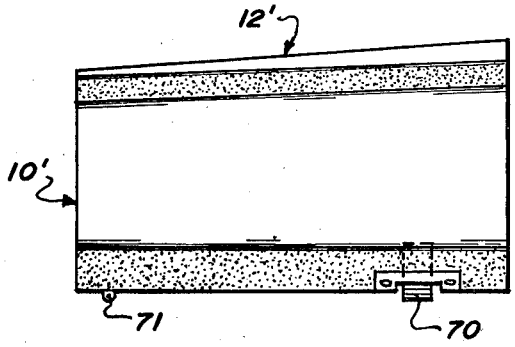
FIG. 14 is a right side elevation of the ski exerciser of FIG. 13.

Finally, FIGS. 13 and 14 show yet a third embodiment of the invention, substantially identical to the embodiment of FIGS. 1 and 2 except for the addition of a wheel 70 which contacts the floor surface to permit the exerciser to be rotated about a pivot 71, to allow the user an additional degree of freedom.

With the structure of several devices embodying the invention having now been considered in detail, the most important distinctions between the instant invention and the prior art may be drawn. As mentioned earlier, some devices according to the prior art provide the user with ski-simulating positions similar to those obtained using the embodiments herein disclosed. Even so, the structure of embodiments of the invention is totally unlike that of the prior art devices which obtain similar ski-simulating positions. For example, embodiments of the instant invention are much more compact, and thus more portable, than the apparatus described in U.S. Pat. No. 3,547,434, mentioned previously. More important still, apparatus embodying the invention can be manufactured at lesser cost, especially for high volume production. As an illustration, the parts shown in FIGS. 1 and 2 can conveniently be molded of lightweight and inexpensive, but strong, foam plastic material. Furthermore, no assembly is necessary and only two different molds are required because the foot pedals are identical.

Essentially the same exercising technique can be employed in using any of the embodiments disclosed. That is, with his feet parallel and resting squarely on the foot pedals, the user may obtain either of the transverse positions illustrated by FIGS. 3 and 4.

Figure 6:
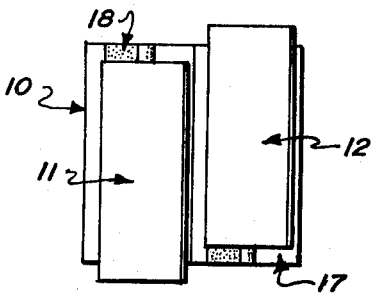
FIGS. 5 and 6 are top plan views of the exerciser of FIGS. 3 and 4 respectively showing the fore and aft travel of the foot pedals during operation.
Figure 5:
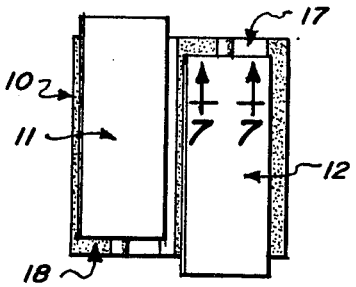

With reference to the preceeding discussion of structure, the following four points will be readily understood. Most obvious is elevation of the uphill foot pedal in simulating a traverse. Second, to properly simulate edging, the uphill edge of each foot pedal is slightly lower than the downhill edge when either the left or right traverse position is obtained. Third, the user's weight must be properly ditributed to maintain the semi-stable position of the base 10. While edging properly, the majority (more than about 55%) of the user's weight must be supported on downhill foot. This weight shift is required by the sideways movements of the foot pedal contact lines with respect to the apex 13 of the base 10. And finally, as can be seen from FIGS. 5 and 6, the uphill foot pedal can be placed forward of the downhill foot pedal, simulating a proper traverse position employed while actually skiing.

The user can simulate a parallel ski turn by a quick vertical (either up or down) movement of his body to unload the foot pedals, followed by a flowing change to the opposite traverse position. The third embodiment, illustrated in FIGS. 13 and 14, also allows the user to actually change direction to further enhance the simulation.

Although the invention has been described and illustrated with a certain degree of particularity, it should be understood that the present disclosure is made by way of example only and that numerous changes in the arrangement and combination of parts may be used without departing from the spirit and scope of the invention as hereinafter claimed.

I claim:

1. A device for simulating skiing conditions comprising:

a base having a pair of V-shaped parallel grooves running front to back along a top surface thereof, a downward surface on said base tapered upwardly from a central longitudinal apex along a front to back axis of the base and about which said base can be rocked from side to side and, a pair of generally triangular cross-section foot pedals each locatable in a respective one of said parallel grooves with an angled portion thereof extending downwardly into said groove to support said foot pedal therewithin, and about which said foot pedal can be rocked from side to side independently of said base, whereby when a user stands on the foot pedals of said device, the user can rock the foot pedals and the block to simulate skiing conditions.

2. The device of claim 1 wherein said angle portions which support said foot pedals are rounded and wherein bottoms of said parallel grooves are correspondingly rounded to receive said angled portion to facilitate smooth foot pedal rocking.

3. The device of claim 1 wherein said base has angles and height whereby its rocked position can only be maintained by distributing more than about 55% of the user's weight on a downhill foot pedal.

4. The device of claim 3 wherein said base is of height of approximately 5 inches.

5. The device of claim 1 wherein said support angled portion of each of said foot pedals is grooved concavely along at least a portion of its length and further comprising a convexly curved protrusion along the bottom of each of said V-shaped grooves upon which said foot pedals ride within said concave grooves.

6. The device of claim 1 wherein said foot pedals are slideable longitudinally within said V-shaped grooves, and further comprising means for limiting the forward and backward extent of the sliding of said foot pedals.

7. The device of claim 1 wherein said "V" shaped groove is grooved along its bottom and said support angled portion is grooved along its length and further comprising a spline within said grooves to prevent lateral slipping of said foot pedals in said V-shaped grooves.

8. A device, comprising:

two foot pedals of generally triangular cross-sectional shape, an apex of said shape being oriented downwardly, a block moveable between semi-stable side-to-side positions, having two parallel V-shaped grooves along a top surface to receive said foot plates, the angle between the walls of said V-shaped grooves being larger than the angle between the walls of said downwardly oriented apex of said foot pedals, whereby the foot pedals are rotatable from side-to-side about said apex within said grooves.

9. The device of claim 8 further comprising bearing means between said block within said V-shaped grooves and said foot pedals.

10. The device of claim 9 wherein said bearing means are curved mating surfaces.

11. The device of claim 10 wherein said curved mating surfaces are a concave surface along the apex of said foot pedals and a convex surface along the base of said V-shaped grooves.

12. The device of claim 10 wherein said curved mating surface are a convex surface along the apex of said foot pedals and a concave surface along the bottom of said V-shaped grooves.

13. The device of claim 8 wherein said block is formed with a base having a central apex parallel to said V-shaped grooves from which the bottom sides rise to define semi-stable positions of said block on each side of said apex.

14. The device of claim 8 further comprising means for facilitating rotation of said base.

15. Apparatus for simulating ski conditions, comprising:

a pair of foot pedals, each of generally triangular cross-sectional shape, a base, said base having a top having a pair of front to back parallel V-shaped grooves for receiving said foot pedals, whereby said foot pedals are rotatable from side to side within said grooves, said base having an unstable supporting surface whereby said base is rotatable from side-to-side upon said supporting surface.

16. The apparatus of claim 15 wherein said unstable supporting surface comprises two angularly disposed sides intersecting at a central front to back apex, whereby said base is rotatable about said apex from one side to an other side.

* * * * *